United States Patent [19]

Ohlsson

[11] 4,384,440

[45] May 24, 1983

[54] METHOD FOR THE CONTINUOUS MANUFACTURE OF PACKING CONTAINERS

[75] Inventor: Wilhelm I. Ohlsson, Malmö, Sweden

[73] Assignee: Tetra Pak Developpement SA, Pully-Lausanne, Switzerland

[21] Appl. No.: 197,072

[22] Filed: Oct. 15, 1980

[30] Foreign Application Priority Data

Nov. 9, 1979 [CH] Switzerland ..... 10066/79

[51] Int. Cl.[3] ..... B65B 43/08

[52] U.S. Cl. ..... 53/412; 53/449; 53/451; 53/456; 53/173; 53/551; 53/554

[58] Field of Search ..... 53/412, 442, 449, 451, 53/456, 452, 173, 453, 486, 557, 559, 202, 563, 562, 554, 551, 552, 131, 478; 493/212, 87, 923, 924, 192, 218, 219

[56] References Cited

U.S. PATENT DOCUMENTS

| | | | |
|---|---|---|---|
| 2,293,142 | 8/1942 | Johnson | 53/452 X |
| 2,503,171 | 4/1950 | Power | 53/452 X |
| 2,663,461 | 12/1953 | Brown | 53/452 X |
| 2,691,259 | 10/1954 | Weckesser | 53/452 |
| 2,718,105 | 9/1955 | Ferguson et al. | 53/452 X |
| 3,000,152 | 9/1961 | Downie | 53/452 X |
| 3,011,293 | 12/1961 | Rado | 53/452 X |
| 3,219,240 | 11/1965 | Campbell, Jr. | 493/87 X |
| 3,469,760 | 9/1969 | Rausing et al. | 53/451 X |
| 3,537,225 | 11/1970 | Fields | 53/452 X |
| 3,747,746 | 7/1973 | Newman et al. | 53/442 |
| 3,807,118 | 4/1974 | Pike | 53/452 X |
| 3,975,885 | 8/1976 | Carlisle | 53/452 |
| 4,061,702 | 12/1977 | Kessler | 53/452 X |

FOREIGN PATENT DOCUMENTS

| | | | |
|---|---|---|---|
| 1077134 | 3/1960 | Fed. Rep. of Germany | 53/554 |
| 1067307 | 11/1952 | France | 53/453 |

*Primary Examiner*—Horace M. Culver

*Attorney, Agent, or Firm*—Burns, Doane, Swecker & Mathis

[57] ABSTRACT

The invention relates to a continuous manufacture of packing containers comprising an outer rigid casing and an inner baglike container. The inner container is manufactured by arranging first seals in pairs at equal distances, substantially in transverse direction of the web, whereupon mandrels are introduced into the web which has been provided with seals. Opening devices are applied to the web with the help of the mandrels as backing. After the mandrels have been withdrawn the free edges of the web are sealed to one another and the contents are introduced into the tube formed. The tube is sealed in its transverse direction along narrow sealing regions to form filled and closed containers which are separated from one another and are introduced into a rigid casing.

22 Claims, 5 Drawing Figures

Fig.2a
Fig.2b
Fig.2c
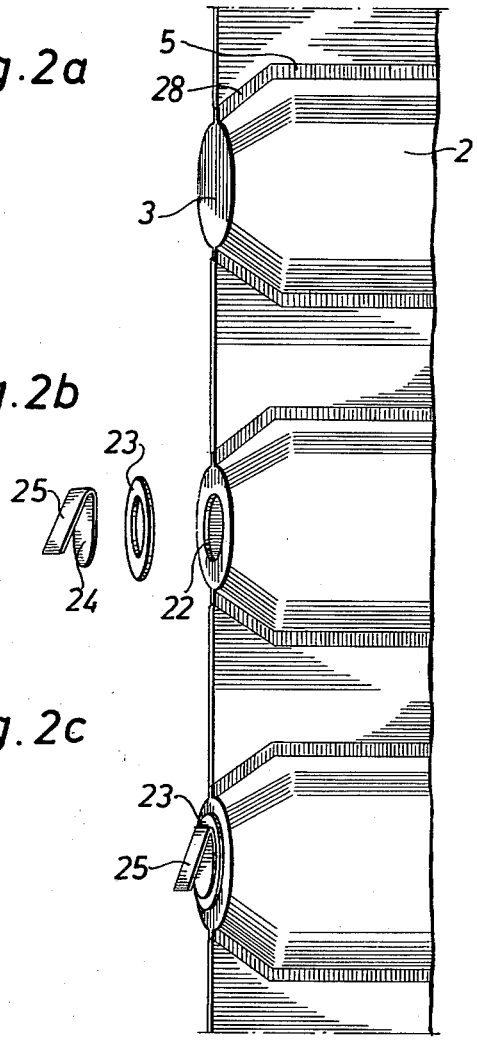
Fig.3
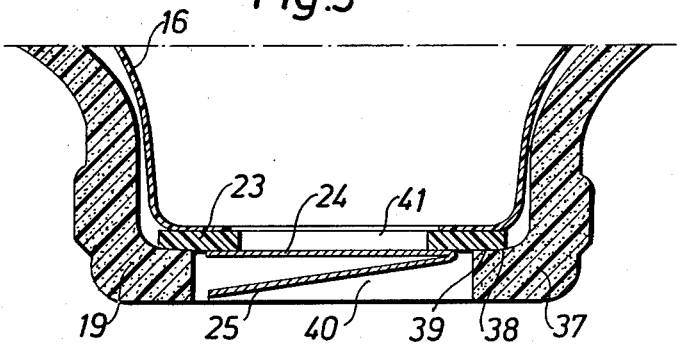

METHOD FOR THE CONTINUOUS MANUFACTURE OF PACKING CONTAINERS

BACKGROUND AND SUMMARY OF THE PRESENT INVENTION

The present invention relates to a method and apparatus for the continuous manufacture of packing containers comprising a rigid casing and an inner thin baglike container.

Beverages, such as juice and wine, are most frequently packed in glass bottles which, however, require energy to manufacture, are breakable and heavy which renders the transport of the packages more expensive. Another disadvantage is that glass bottles, if returnable, are expensive to wash, collect and return and, if non-returnable, create considerable environmental problems. There is consequently a great need for a light and inexpensive package which is at the same time environmentally acceptable and provides satisfactory protection for the contents.

The present invention relates to a method for the manufacture of such a package, which method is characterized in that a double web of thin packing material, e.g. plastic film or a laminate comprising several material layers, is advanced by an intermittent or continuous movement. The double web comprises two layers of packing material and the material layers in the double web are sealed to one another along narrow first sealing joints arranged in pairs and extending substantially in transverse direction of the double web. One or more mandrels are introduced between the said narrow first sealing joints arranged in pairs and are inserted so that with their front parts they extend up to or close to the longitudinal edge of the double web adjacent first sealing joints are made to coincide in pairs or to overlap each other with their sealing joints facing one another. The mandrels are withdrawn from the double web, whose free longitudinal sealing joints are then joined together in a second longitudinal sealing joint to form a tube of varying cross-section; tube is filled with the intended contents by a filler pipe introduced into the tube. The tube is divided into individually filled and closed containers by third sealing joints located across the tube, which extend from the first to the said second sealing joints. The filled and closed tube portions are severed from one another by cuts through the third sealing joints, and the severed baglike containers thus obtained are introduced into the rigid casing and fixed there.

BRIEF DESCRIPTION OF THE DRAWINGS

An embodiment of the invention will be described in the following with reference to the enclosed schematic drawing, wherein like members bear like reference numerals and wherein:

FIGS. 2*a*, 2*b* and 2*c* are sequential schematic views of an opening device being applied to the container, and FIG. 3 is a cross-sectional view of the finished container with the inner bag is fixed to the outer casing.

DETAILED DESCRIPTION OF THE PREFERRED EMBODIMENT

Figure 1:
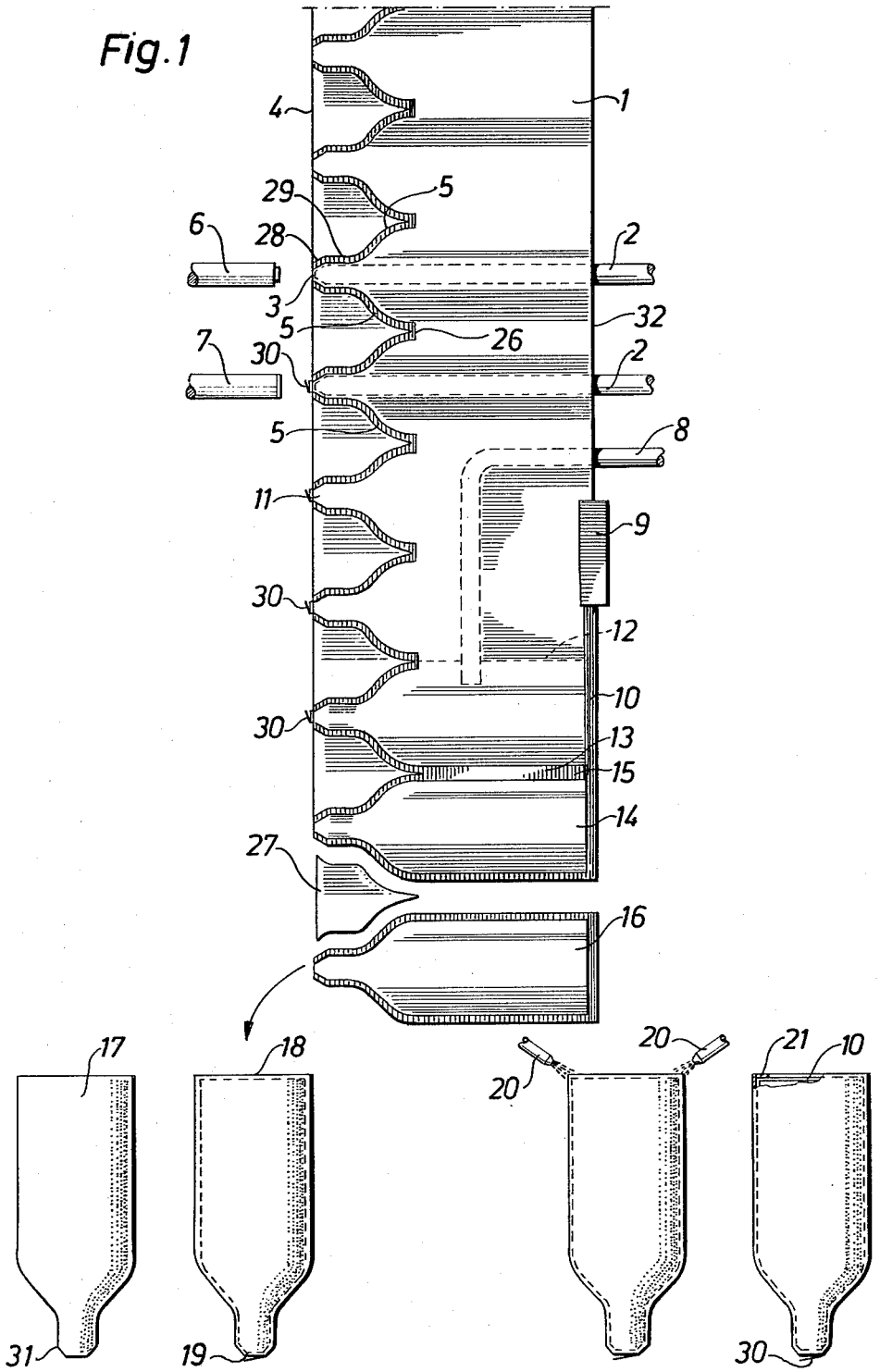
FIG. 1 is a schematic view of the manufacture of the packing containers.

With refrence to FIG. 1 a double plastic film or thin laminate 1 may be constituted of a web folded double, of two single webs placed together, or of a seamless tube which is flattened and is cut open alone one of the longitudinal edges or possibly both the longitudinal folded edge lines formed during the flattening of the tube. The advantage in using a seamless tube is that such a tube becomes internally sterile during the extrusion operation. Accordingly, the packaging operation can be aseptic if further infection-preventing measures are adopted, or at least the packaging operation will be extremely hygienic since the seamless tube is cut up only in connection with the manufacture of the package and the introduction of the contents.

If a seamless tube of thin plastic material or laminate is used for a start it is then only necessary to cup up the one longitudinal edge of the flattened tube in order to make it possible to introduce a filler pipe into the tube. However during forming it has been found to be easier to shape the constructed "neck portion" of the inner thin plastic container without crease formation, if the opposite longitudinal edge region of the tube is also cut open.

The material in the web 1 may consist of plastic film or of a laminate of several plastic materials, the laminate combination possibly comprising gas-tight layers, sealable layers, etc. The laminate material may be manufactured either by laminating prefabricated films to one another or by extruding several plastic materials onto one another or jointly in a co-extrusion process. The packing material may consist e.g. of a laminate comprising a base layer of oriented polyester which has very good mechanical tensile strength characteristics, and a gas-tight layer of e.g. polyvinylidene chloride, polyvinyl alcohol or a modified polyvinyl alcohol which is marketed under the trade name EVAL. In order to make the laminate sealable it may be covered on either side with a thin polyethylene film, or else with a glycol-modified polyester film of the type which retains its sealing capability even after orientation stretching.

In the present case it is assumed that the double web is manufactured starting from a seamless tube which is flattened, whereupon the two longitudinal edges of the tube are cut open so that two separate plastic films lying on top of one another are formed. By means of sealing elements, not shown in the drawing, which may be of the conventional type and which preferably consist of a co-operating sealing jaws which are situated on either side of the double web 1 to press the same together, the material layers pressed together are sealed to one another with simultaneous application of heat along narrow sealing zones 5. As it is intended in the present case that the container manufactured should be in the shape of a bottle, the sealing zones or joints 5 are shaped correspondingly. The sealing joints 5 extend from the edge zone 4 substantially transversely across the double web 1, but no farther than a line corresponding approximately to half the width of the web. To facilitate the forming of the front part 19 of the inner container, the sealing joint 5 may run at a slight angle along a portion 28 near the edge 4.

After completion of the sealing joints 5 first which in themselves may be carried out one by one or in pairs or else as a number of seals performed at the same time, the sealing jaws are separated, whereupon the double web is stepped forward over a length corresponding to one or a number of container part widths, depending on how many container parts are processed in one and the same operation at each processing station. After the stepping forward of the double web 1, new first sealing joints 5 are performed on the non-sealed web brought forward while mandrels 2 are introduced into the advanced part of the web which has been provided with the first sealing joints 5. The mandrels 2 are introduced into the constricted portion of the seals 5, so that a plane front surface 3 of the mandrels will projects up to the longitudinal edge 4 of the web. Since the sealing joints 5 at the edge 4 of the web have been provided with a portion 28 which is angled obliquely inwards, the front end 3 of the mandrels will strentch the plastic material at the edge 4 in the area between the sealing joints or seals 5 so that a portion of the plastic material is stretched flat over the front surfaces 3 of the mandrels. In this way a flange is formed whose plane substantially coincides with the longitudinal axis of the web.

In the case where the double web 1 is constituted of a web folded double and the edge 4 is constituted of a folding edge or of a sealing joint, the material will be stretched flat over the whole front surface of the mandrels 2. A non-sealed or cut edge 4 will produce a substantially annular flange on the front surface 3 of the mandrels 2.

In cases where the edge is sealed or closed in some other manner a preferably circular opening hole is punched into the material portion stretched flat over the front surface 3 of the mandrel 2 by a punching device 6. After the punching operation the web 1 is advanced further over a distance corresponding to a package width, preferably while the mandrel continues to be engaged with the web. Assuming that the mandrels 2 are adapted so that they can move synchronously with the web. It is also possible, however, to withdraw the mandrels 2 before the stepwise movement of the web and to introduce new mandrels into the area between the seals 5 in a new processing station after the web 1 has been stepped forward.

When the web 1 has been advanced one or several package widths an opening device 30, covering the existing or punched-out hole is applied with the help of the applicator 7. The opening device 30 may be transferred and applied, for example, by employing a method similar to the thermal bonding portion of the method disclosed in U.S. Pat. No. 3,475,243 issued Oct. 28, 1969 to Scalora. The design of this opening device 30 will be described in detail later. On carrying out the sealing joint 5 it is ensured that the inner part of the sealing joint 5 overlaps or at least comes into contact with a sealing joint 5 produced in an earlier sealing operation in the area 26, so that a continuous sealing line, whose end points are situated on the edge 4, is formed.

After application of the opening device 30 the mandrel 2 is withdrawn and the double web 1 is advanced a further step forwards, past a stationary filler pipe 8 whose mouth is located inside the double web 1. On further advancing of the double web 1 the web free edges 32 are sealed to one another by a sealing device 9 to form a longitudinal second sealing joint 10 which form the double web 1 into a tube of varying cross-section owing to the sealing line 5 having varying distance from the sealing line 10. Into the tube so formed liquid contents, e.g. juice or wine, are introduced through the filler pipe 8, the level of the contents being designated by numeral 12. After a further advance of the tube formed, the same is divided into individual tube portions by means of third transverse seals 13, performed with the help of sealing devices (not shown). The transverse seals 13 are carried out so that the tube is pressed flat along narrow zones below the liquid level 12 with simultaneous application of heat, so that the heated tube portions or material layers pressed against one another are induced to fuse together to form a tight and lasting sealing joints joint 13.

By means of such repeated sealing 13, wholly closed and filled tube portions 14 are formed which can be divided into separate container units by cuts 15 through the sealing zones 13. In connection with this cutting operation it is also possible by a simple punching operation to punch out and remove the material 27 in the area between the bottleneck-shaped seals 5. The filled and closed containers 15 of thin plastic material formed in this manner are then introduced into a premanufactured sleeve or casing 17, whose front end presents a constriction 31 corresponding to the part of the container 16 formed by the sealing joints 5. The container 16 is introduced through an open end 18 of the casing 17 and is allowed to penetrate by force of gravity into the casing 17 so that the front part 11 of the container 16 will be in contact with the front part 19 of the casing 17 in a manner. In other words, the container is dumped or dropped into the casing 17 as shown by the arrow in FIG. 1. It is assumed that the casing 17 is made of a shrinkable rigid material, e.g. oriented polyestyrene foam, and that the constricted part 31 has been produced in that the one end of the casing of sleeve 17 has been heated uniformly so that the sleeve shrinks to give the bottleneck-shaped constriction 31. After the container part 16 has been introduced into the casing 17 the edge 18 of the casing 17 can also be heated by heating devices 20, e.g. hot-air units or radiant heat sources, so that the edge zone shrinks to form a flange 21. In order to protect the inner thin, baglike, container part 16 from outside effects it is possible before the shrinking operation in which the flange 21 is formed, to introduce a disc of substantially the same cross-section as the casing 17 through the end 18 and fasten the disc by shrinkage so that the disc forms a protective wall between the bottom of the container 16 and the bottom opening of the casing 17. The containers may be inserted in the casing 17 and the disc may be placed on the bottom of the casing in a manner similar to that described in U.S. Pat. No. 3,469,760 issued Sept. 30, 1969 to Rausing et al.

The construction and application of the opening device is illustrated in FIGS. 2*a*, 2*b* and 2*c*. With reference to FIG. 2*a*, the mandrel 2 projects from the plastic film over the plane front working surface 3 and how sealing joints 5 are arranged on either side of the mandrel 2 with an inward-curving portion 28 close to the plane surface 3 so as to facilitate the shaping of the portion of the container. With reference to FIG. 2*b* a hole 22 has been punched into the stretched part of the double web 1, and the hole 22 is covered over by a plastic disc 23 and a covering strip 24, which is fixed as a seal over a hole in the plate 23. The covering strip 24 can be torn off by means of a pull-plug 25.

With reference to FIG. 2*c* the disc 23 has been fixed over the hole 22 to form a seal by heat-sealing possibly with hot-melt.

The disc 23 can be provided in advance with the cover strip 24 so that the whole unit consisting of the disc 23 and the cover strip 24 is fixed secured over the hole 22 with the help of heat and pressure.

With reference to FIG. 3 the container 16 is fixed inside the outer casing 17 by forming mouth portion 19 of the outer casing 17 with an inwardly facing flange 37 having a plane supporting surface 38 turned towards the interior of the casing. The inward extension of the flange 37 is limited by a central hole 40 in the mouth portion 19 of the casing 17.

The filled and closed container 16 is introduced into the casing 17 in the manner which has been described. The disc 23 of the opening device is brought into contact with the inside 38 of the flange 37, and the disc 23 and the flange 37 are joined together with the a heat-activated melting glue, i.e. hot-melt 39, which has been applied e.g. to the outside of the disc 23 and which has been activated through the supply of heat just before the disc 23 and the flange 37 are brought in contact with one another. The cover strip 24 covering the hole 41 of the disc 23 and the pull-lug 25 attached to the cover strip 24 are so dimensioned that they are completely accommodated in the hole 40 which is defined by the edge of the flange 37. In this way the pull-lug 25 is accessible from the outside of the casing 17.

When the contents of the package are to be made accessible, the package is opened by pulling upwardly on the pull-lug 25 of the cover strip 24, as a result of which the cover strip 24 is detached from the ring 23 and the emptying hole 41 is exposed.

It has been found that by application of the method in accordance with the invention packing containers can be manufactured in a rational manner and with high capacity.

In the description given above no details are given as to how the mandrels 2 are maneuvered and guided. In an intermittent process two sets of mandrels are conceivable, each comprising two or three mandrels, one set of mandrels being made to engage with the folded web 1 and being moved synchronously with the web between stations where the sealing of the sealing joints 5 and the attachment of the opening device are carried out.

Beside an intermittent movement of the web 1, wherein the same is moved together with the mandrels 2 between different stations in which processing operations are carried out, the web 1 can also be made to move in a continuous movement. In this arrangement, the sealing elements, punching devices and opening device applicators must likewise be able to move synchronously with the web 1, which complicates the construction of the arrangement.

The method in accordance with the invention given here as an example is intended only to present the idea of the invention, and it is possible within the scope of the same to modify method and arrangement as mentioned above, by carrying out the processing operations during a continuous movement of the web, and it is also possible to vary the shape of the sealing joints and the shape of the mandrels so as to obtain a package of a desired appearance. Naturally, it is also possible to modify the design of the emptying opening or even wholly to omit the emptying opening and to open the package by exposing the wall of the inner bag-like container in an opening of the outer casing to be punctured e.g. through the introduction of a separate pouring pipe.

The principles, preferred embodiment and mode of operation of the present invention have been described in the foregoing specification. However, the invention which is intended to be protected is not to be construed as limited to the particular embodiment disclosed. The embodiment is to be regarded as illustrative rather than restrictive. Variations and changes may be made by others without departing from the spirit of the present invention. Accordingly, it is expressly intended that all such variations and changes which fall within the spirit and scope of the present invention as defined in the claims be embraced thereby.

I claim:

1. A method for the continuous manufacture of packing containers comprising the steps of advancing a double web of thin packing material, said double web comprising two layers of packing material, sealing the material layers in the double web to one another along narrow first sealing joints arranged in pairs and extending substantially transverse to the direction of movement of the double web, inserting a mandrel between said narrow first sealing joints arranged in pairs such that a front surface of the mandrel extends up to or close to a longitudinal edge of the double web, adjacent first sealing joints coinciding in pairs or overlap each other with the sealing joints facing one another, withdrawing said mandrels from the double web, joining free longitudinal sealing edges of the web together in a second longitudinal sealing joint to form a tube of varying cross-section, filling said tube with the intended contents through a filler pipe introduced into the tube, dividing the tube into individually filled and closed containers by sealing third sealing joints located across the tube which third sealing joints extend from said first to the said second sealing joints, severing the individually filled and closed containers from one another by cutting through said third sealing joints, inserting the severed baglike containers thus obtained into a rigid casing, and securing the containers within the casings.

2. The method in accordance with claim 1, further comprising forming said double web including the step of folding a plane web generally in half upon itself.

3. The method in accordance with claim 1, further comprising forming said double web including the steps of flattening a seamless tube and cutting the tube along at least one of the longitudinal edges of the flattened tube.

4. The method in accordance with claim 1, wherein said rigid casing is tubular and further comprising shrinking one end of the casing into a constricted, bottleneck-shaped portion, and forming a mouth in said portion with an inwardly-turned flange having a plane edge region facing towards the interior of the casing.

5. The method in accordance with claim 1, wherein the step of inserting the mandrels into the double web and between the first sealing joints arranged in pairs includes stretching flat the material in the edge zone of the double web over the front surfaces of the mandrels.

6. The method in accordance with claim 5, wherein the packing material in the area of the joint longitudinal edge zone of the double web stretched by the front surface of the mandrels forms a flangelike sealing surface, and further comprising sealing a relatively rigid annular part over said sealing surface.

7. The method in accordance with claim 6, further comprising forming the double web by folding a plane web generally in half upon itself, punching through said plastic film stretched flat over the front surfaces of the mandrels to form an emptying hole and a flangelike sealing surface arranged around the emptying hole, arranging the hole of said annular part to coincide with the emptying hole punched out in the web, and arranging a tear-off cover strip over the hole of the annular part.

8. The method in accordance with claim 7, further comprising folding in a pull-lug of said cover strip over the sealed emptying hole.

9. The method in accordance with claim 8, wherein the containers provided with emptying holes are arranged such that when inserting the containers into the outer rigid casing the outside of the rigid annular part contacts and is fixed to the inside of a flange arranged at an opening of the casing in such a manner the the pull-lug and the cover strip which are both attached over the emptying hole of the annular part will be exposed and wholly accommodated in the opening formed by the flange of the casing whereby said pull-lug is accessible from the outside of the casing.

10. The method in accordance with claim 4, further comprising forming an edge of an end opening of said casing which end opening is situated opposite the end of the casing provided with the bottleneck-shaped portion by shrinkage under the effect of heat into an inwardly-turned flange after the container has been inserted into the casing.

11. The method in accordance with claim 10, further comprising arranging an end disc of a size substantially corresponding to the cross-section of the casing in the end opening of the casing after the container has been inserted and before the end opening of the casing has been formed by shrinkage into the inwardly-turned flange.

12. The method in accordance with claim 4, wherein the outer casing comprises a layer of heat-shrinkable foamed plastics, preferably polyestyrene foamed plastice.

13. The method in accordance with claim 4, wherein said first sealing joints are arranged adjoining the inserted mandrels whose size is slightly less than an inside dimension of the mouth of the bottleneck-shaped portion of the casing.

14. An apparatus for the manufacture of packing containers, comprising means for intermittently or continuously advancing a double web, a plurality of movable mandrels having a plane front working surface, each of said mandrels being adapted to be introduced between the material layers of said web between narrow first sealing joints arranged in pairs and extending substantially transverse to the web, first sealing elements for sealing together the double web along the narrow first sealing joints, second sealing elements for sealing together a free edge of the double web along a second sealing joint, a filling device for supplying liquid contents of the tube formed of the double web after sealing along said first and second sealing joints, third sealing elements for sealing together the double web along narrow third sealing joints extending from the first sealing joints to the second sealing joint, means for separating the filled and closed containers by cutting through the third sealing joints.

15. The apparatus in accordance with claim 14, further comprising means for punching holes in a portion of the web resting against the plane front working surfaces of the mandrels, and means for applying an opening arrangement over said punched holes.

16. The apparatus in accordance with claim 15, further comprising means for inserting the separated, filled and closed containers into casings of rigid material, and means for the fixing the containers in said casings including means for heating and applying hot-melt to the opening arrangement of the containers, and means for heating edge regions of the casing for shrinking said edge regions to form a flange extending over a portion of an open end of the casing.

17. The method in accordance with claim 1, wherein the double web is advanced continuously or intermittently.

18. The method in accordance with claim 6, wherein the relatively rigid annular part is plastic material.

19. A method of making a packing container comprising the steps of:

advancing a double web of thermoplastic material;

progressively heat sealing portions of the web along one longitudinal edge including providing openings for receiving closure members;

subsequently securing one closure member over each of the openings;

progressively heat sealing the other longitudinal edge of the web to form a tube;

filling said tube with intended contents;

heat sealing said tube along spaced apart transverse sealing zones to form filled bag-like containers contiguous with the double web;

separating the containers from the double web;

inserting each of the containers in a preformed casing with the closure member exposed to an extension of the casing; and securing the container in the casing.

20. The method in accordance with claim 19, wherein the openings for receiving closure members are formed by punching through said one longitudinal edge.

21. The method in accordance with claim 19, wherein said casing includes an opening at an end opposite said extension, and further comprising arranging an end disc over said opening after inserting the bag-like container in the casing and securing the end disc to the casing.

22. An apparatus for making a packing container from a double web comprising:

means for sealing first portions of a first side of the double web;

a movable mandrel having a plane working surface, said mandrel being adatped to be inserted between layers of the double web such that a second portion of the first side of the web rests against the plane working surface of the mandrel;

means for punching a hole in the second portion of the web resting against the working surface of the mandrel;

means for applying an opening arrangement over said punched hole;

means for sealing the remaining side and transverse portions of the web to form a closed, bag-like container;

means for inserting the container in a preformed casing such that the opening arrangement is exposed to an extension of the casing; and means for securing the container within the casing.

* * * * *